US011401082B2

(12) United States Patent
Hughes et al.

(10) Patent No.: US 11,401,082 B2
(45) Date of Patent: Aug. 2, 2022

(54) FUSIBLE CAP ASSEMBLY

(71) Applicant: Power Packer North America, Inc., Westfield, WI (US)

(72) Inventors: Ronald Christopher Hughes, West Des Moines, IA (US); James Allen Miller, Sharpsburg, IA (US); Michael Patrick Reinsvold, West Des Moines, IA (US)

(73) Assignee: Power Packer North America, Inc., Westfield, WI (US)

( * ) Notice: Subject to any disclaimer, the term of this patent is extended or adjusted under 35 U.S.C. 154(b) by 113 days.

(21) Appl. No.: 16/731,440

(22) Filed: Dec. 31, 2019

(65) Prior Publication Data

US 2020/0207526 A1 Jul. 2, 2020

Related U.S. Application Data

(60) Provisional application No. 62/786,791, filed on Dec. 31, 2018.

(51) Int. Cl.

| | |
|---|---|
| ***B65D 43/02*** | (2006.01) |
| ***B65D 55/06*** | (2006.01) |
| ***B65D 53/02*** | (2006.01) |

(52) U.S. Cl.

CPC ..... *B65D 43/0231* (2013.01); *B65D 53/02* (2013.01); *B65D 55/06* (2013.01)

(58) Field of Classification Search

CPC .... B65D 43/0231; B65D 53/02; B65D 53/04; B65D 55/06; B65D 51/16; B65D 51/1622; B65D 51/1633; B65D 51/1644; B65D 47/32; B65D 79/005

USPC ..... 220/201; 215/270, 248, 307

See application file for complete search history.

(56) References Cited

U.S. PATENT DOCUMENTS

| | | | | |
|---|---|---|---|---|
| 1,864,380 | A | | 6/1932 | Te Pas |
| 3,720,220 | A | | 3/1973 | McMath |
| 4,457,325 | A | * | 7/1984 | Green ..... F16K 17/196 137/39 |
| 4,503,675 | A | | 3/1985 | Gardner et al. |
| 4,796,777 | A | | 1/1989 | Keller |
| 5,031,790 | A | | 7/1991 | Keller |
| 5,111,837 | A | | 5/1992 | Morris et al. |
| 5,275,194 | A | | 1/1994 | Gray, Jr. |
| 5,325,882 | A | | 7/1994 | Forsythe et al. |
| 5,632,297 | A | | 5/1997 | Sciullo et al. |

(Continued)

*Primary Examiner* — Ernesto A Grano

(74) *Attorney, Agent, or Firm* — Michael Best & Friedrich LLP

(57) ABSTRACT

A cap assembly for a container and a method of assembly. The cap assembly includes a housing couplable to a container opening, the housing defining a housing opening communicating with the container opening; a cover operable to close the housing opening; and a retainer mechanism operable to releasably connect the cover to the housing, the retainer mechanism including a non-fusible member selectively contacting the cover and the housing, and a fusible member operable to hold the non-fusible member in contact with the cover and the housing in a retaining condition, the fusible member deforming at or above a threshold of the condition to allow the non-fusible member to move out of contact with one of the cover and the housing, in a release condition, to open the container opening to atmosphere.

21 Claims, 9 Drawing Sheets

(56) References Cited

U.S. PATENT DOCUMENTS

| | | | | |
|---|---|---|---|---|
| 6,321,768 | B1 | 11/2001 | Taylor | |
| 6,367,499 | B1 | 4/2002 | Taku | |
| 7,568,493 | B2 | 8/2009 | Keefer et al. | |
| 8,434,507 | B2 | 5/2013 | Iida et al. | |
| 8,550,105 | B2 | 10/2013 | Ishitoya et al. | |
| 8,596,290 | B2 * | 12/2013 | Kotefski | F16K 17/383 137/72 |
| 8,678,024 | B2 | 3/2014 | Freiler | |
| 8,997,773 | B2 | 4/2015 | Kotefski et al. | |
| 8,997,774 | B2 | 4/2015 | Kotefski et al. | |
| 9,195,240 | B2 | 11/2015 | Bishoff et al. | |
| 9,562,619 | B2 | 2/2017 | Kojima et al. | |
| 2013/0320010 | A1 | 12/2013 | Kotefski et al. | |

* cited by examiner

FUSIBLE CAP ASSEMBLY

RELATED APPLICATION

The present application claims priority to co-pending U.S. Provisional Patent Application No. 62/786,791, filed Dec. 31, 2018, the entire contents of which is hereby incorporated by reference.

FIELD

The present invention relates to caps for containers, tanks, etc., and, more particularly, to a cap assembly operable to vent at or above a threshold.

SUMMARY

Containers (e.g., large tanks, gasoline tanks, etc.) often include cap assemblies that allow the container to vent at or above a predetermined threshold of a condition (e.g., a temperature) in the container. Venting of the container may be desirable to prevent unwanted combustion from a buildup of pressure and an increased temperature within the container.

In one independent aspect, a cap assembly for a container may be provided. The container may include a container opening and have a condition. The cap assembly may generally a housing couplable to the container opening, the housing defining a housing opening communicating with the container opening; a cover operable to close the housing opening; and a retainer mechanism operable to releasably connect the cover to the housing. The retainer mechanism may include a non-fusible member selectively contacting the cover and the housing, and a fusible member operable to hold the non-fusible member in contact with the cover and the housing in a retaining condition, the fusible member deforming at or above a threshold of the condition to allow the non-fusible member to move out of contact with one of the cover and the housing, in a release condition, to open the container opening to atmosphere.

In another independent aspect, a cap assembly may generally include a housing couplable to the container opening, the housing defining a housing opening communicating with the container opening, the housing opening defining an axis; a cover operable to close the housing opening, one of the housing and the cover having a surface extending non-parallel to the axis; and a retainer mechanism operable to releasably connect the cover to the housing. The retainer mechanism may include a first non-fusible member and a second non-fusible member selectively contacting the cover and the housing, and a first fusible member and a second fusible operable to hold the first non-fusible member and the second non-fusible member, respectively in contact with the cover and the housing in a retaining condition, the first fusible member and the second fusible member deforming at or above a threshold of the condition to allow the first non-fusible member and the second non-fusible member, respectively, to move out of contact with one of the cover and the housing, in a release condition, to open the container opening to atmosphere. The first non-fusible member and the second non-fusible member may engage the surface in the retaining condition and disengage the surface in the release condition.

In yet another independent aspect, a method of assembling a cap assembly for a container may be provided. The cap assembly may include a housing couplable to the container opening, the housing defining a housing opening communicating with the container opening, the housing opening defining an axis, a cover, one of the housing and the cover having a surface extending non-parallel to the axis, and a retainer mechanism including a non-fusible member and a fusible member. The method may generally include positioning the cover to close the housing opening; engaging the surface with the non-fusible member; and, below a threshold of the condition, holding the non-fusible member in engagement with the surface with the fusible member to releasably connect the cover to the housing, at or above the threshold, the fusible member deforming to allow the non-fusible member to move out of contact with the surface.

Other independent features and independent aspects of the invention may become apparent by consideration of the following detailed description and accompanying drawings.

DETAILED DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

Relative terminology, such as, for example, "about", "approximately", "substantially", etc., used in connection with a quantity or condition would be understood by those of ordinary skill to be inclusive of the stated value and has the meaning dictated by the context (for example, the term includes at least the degree of error associated with the measurement of, tolerances (e.g., manufacturing, assembly, use, etc.) associated with the particular value, etc.). Such terminology should also be considered as disclosing the range defined by the absolute values of the two endpoints. For example, the expression "from about 2 to about 4" also discloses the range "from 2 to 4". The relative terminology may refer to plus or minus a percentage (e.g., 1%, 5%, 10% or more) of an indicated value.

Also, the functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not listed.

Figure 1:
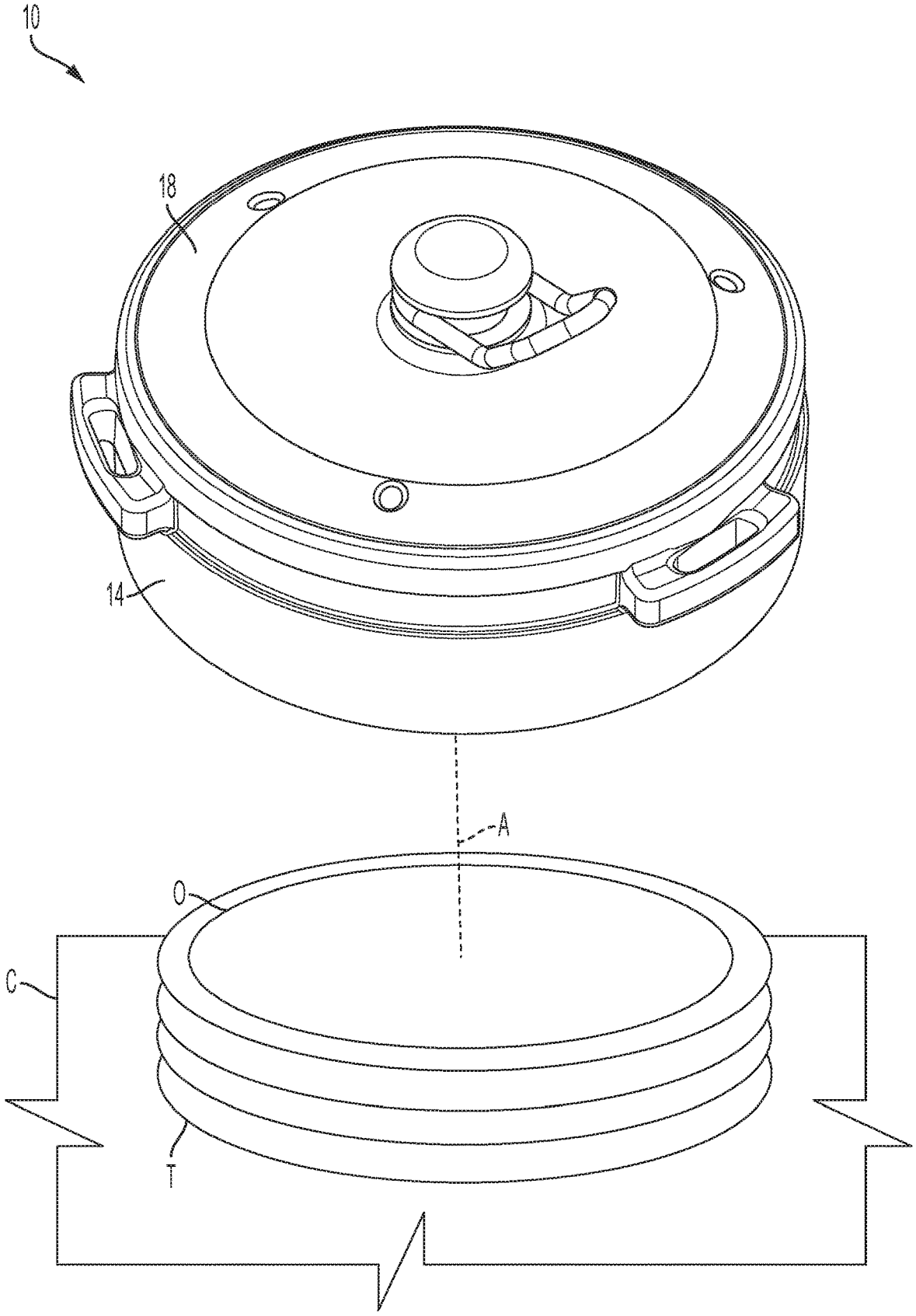
FIG. 1 is a perspective view of a cap assembly for closing a container assembly.
Figure 2:
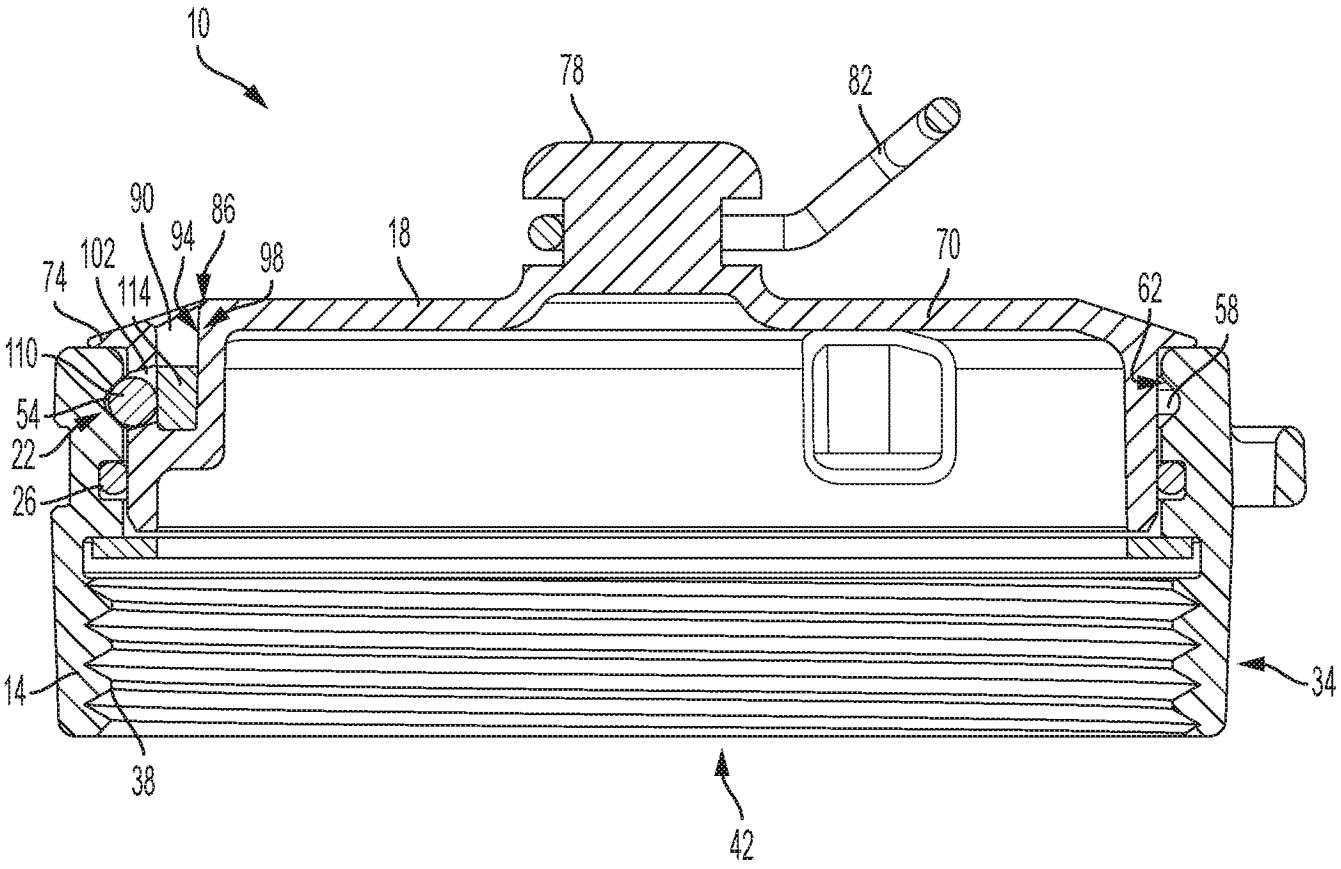
FIG. 2 is a cross-sectional side view of the cap assembly of FIG. 1.
Figure 3:
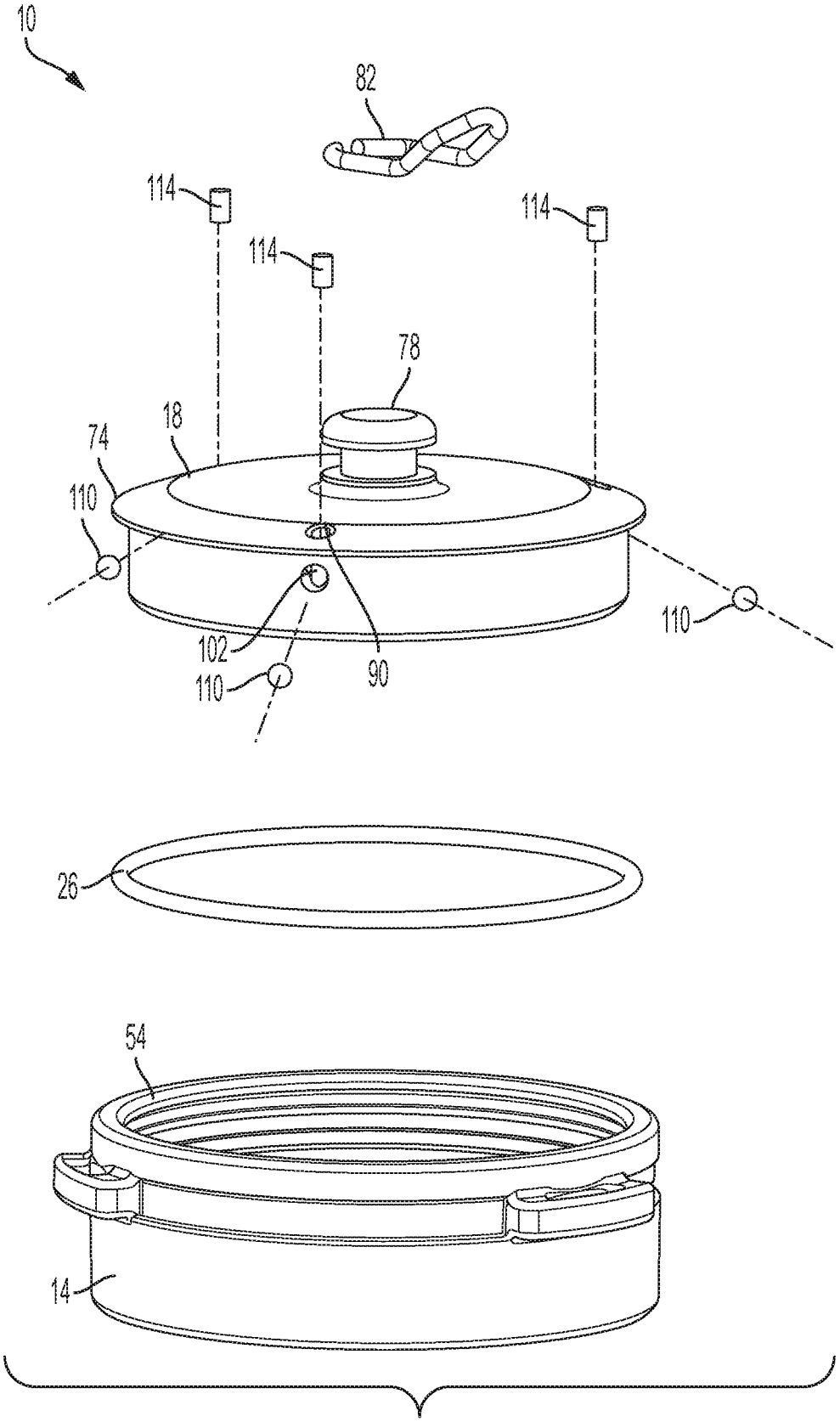
FIG. 3 is an exploded perspective view of the cap assembly of FIG. 1.

FIGS. 1-3 illustrate a cap assembly 10 for use with a container C, such as, for example, a tank, etc., for storing and/or transporting fluids. In some cases, the fluids can combust under certain temperature and/or pressure conditions within the container C. The cap assembly 10 is operable, at or above the threshold, to vent the container C to atmosphere.

The container C defines an opening O selectively closed by the cap assembly 10. The cap assembly 10 generally includes a housing 14 connectable to the container C, a cover 18, and a retainer assembly 22 operable to releasably connect the cover 18 to the housing 14. The cap assembly 10 also includes a seal arrangement with an assembly seal 26 (e.g., an o-ring (Teflon® coated)) positionable and sealing the interface between the housing 14 and the cover 18 and a container seal 30 (e.g., a flexible gasket (Teflon® coated)) to seal against the container C.

Figure 8:
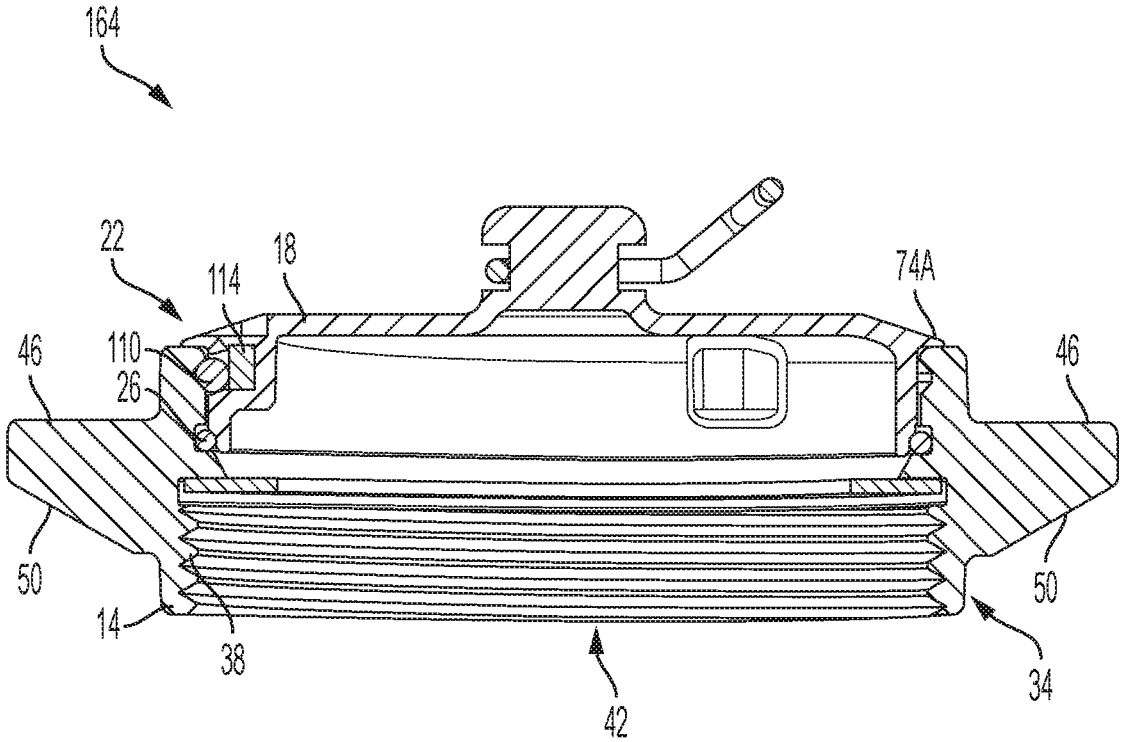
FIG. 8 is a cross-sectional side view of a further alternative construction of a cap assembly.
Figure 9:
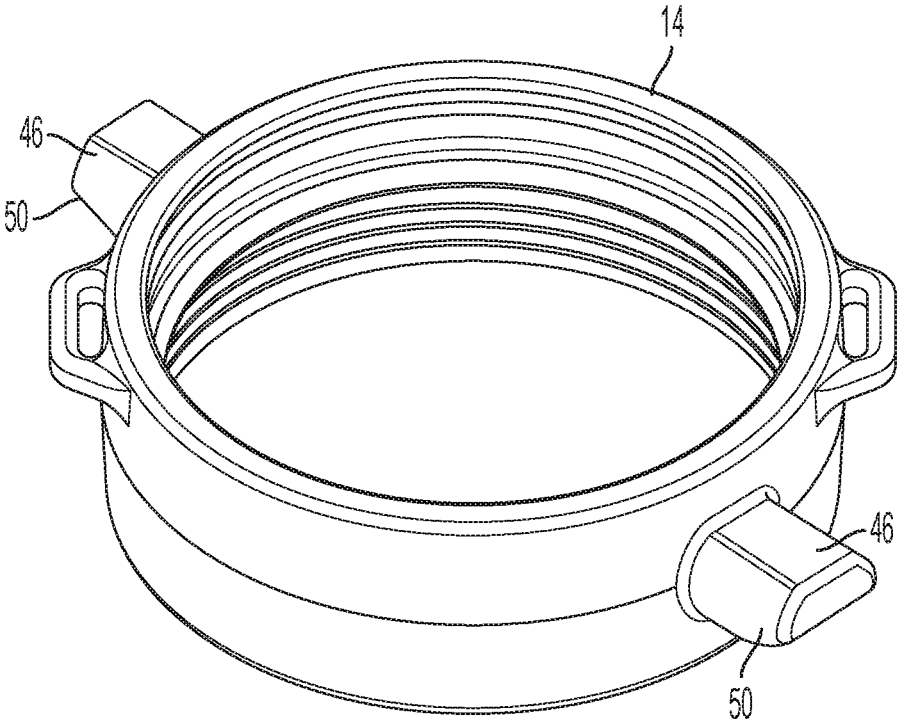
FIG. 9 is a perspective view of a housing of the cap assembly of FIG. 8.

The housing 14 includes a body 34 connectable to the container C by a connecting mechanism (e.g., cooperating container threads T and housing threads 38). The body 34 defines an opening 42 communicating with the container opening O and extending about an axis A. On its outer side surface, the body 34 includes (see FIGS. 8-9) a pair of wrenching lugs 46 engageable by a user to install the housing 14 (and the cap assembly 10) on or to remove the housing 14 (and the cap assembly 10) from the container C. Each lug 46 has a surface 50 tapered away (e.g., at an angle of about 15° to about 60° (about 30°, as shown)) from the container C to cause a sling, a strap, etc. (not shown), which may catch on the lug 46, to move toward and disengage from the free end of the lug 46. In other constructions, the surface 50 may be tapered at an angle of about 15° to about 45°, or at an angle of 45° or less.

One or more recesses 54 are defined in the inner surface of the body 34 about the opening 42. As shown in FIGS. 2-3, the illustrated recess 54 is an annular groove 58 extending about the axis A (e.g., the full circumference, as illustrated) and providing a retaining surface 62. In other constructions, the recess(es) 54 may include one or more openings, bores 66 (see FIGS. 4 and 6-7), grooves (e.g., extending about only a portion of the circumference), etc.

The cover 18 includes a body 70 positionable in the housing opening 42 and a rim or lip 74 engageable against the end surface of the housing 14 to limit insertion of the cover 18 into the opening 42. On its outer end surface, the cover 18 includes a stub 78 with a groove for receiving a lanyard ring 82 to connect the cap assembly 10 to the container C via a lanyard (not shown) when the housing 14 is disconnected from the container C.

One or more recesses 86 are defined in the outer surface of the body 70. As shown in FIGS. 2-3, each illustrated recess 86 is a bore 90, and a number of bores 90 (e.g., three shown) are provided about the axis A (e.g., spaced about 120° apart, as illustrated) and have a retaining surface 94.

As shown in FIG. 2, in the illustrated construction, each bore 90 has an axially-extending portion 98 opening through the top surface of the cover 18, and a generally radially-extending portion 102 communicating with the portion 98 and opening through the side wall of the body 70. The radially-extending portion 102 is angled upwardly toward the axially-extending portion 98. The axially-extending portion 98 extends downwardly beyond the entrance of the radially-extending portion 102.

In other constructions (not shown), the bore(s) 90 may have a different construction. For example, each bore 90 may have only a radially-extending portion 102 extending through to the inner diameter of the body 70. A non-fusible member 110 and a fusible member 114 may be inserted from the inside of the body 70. A seal (not shown) may be added to inhibit the contents of the container C from corroding the retainer mechanism 22.

Also, the body 70 may define fewer or more bores 90, and/or the bores 90 may have a different spacing. In other constructions, the recess(es) 86 may include one or more openings, a full-circumference groove 106 (see FIGS. 4 and 6-7), grooves (e.g., extending about only a portion of the circumference), etc.

The retainer mechanism 22 includes a number of retainer members (e.g., three shown) selectively positionable between and in contact with the retaining surfaces 62, 94 of the housing 14 and the cover 18, respectively, (a retaining condition) to releasably connect the housing 14 and the cover 18. At or above the threshold, the retainer members disengage from at least one of the housing 14 and the cover 18 to release the cover 18 from the housing 14 (a release condition) to open and vent the container C to atmosphere.

As shown in FIGS. 2-3, the illustrated retainer mechanism 22 includes non-fusible members 110, acting as retainer members, and fusible members 114, operable to releasably hold or lock the non-fusible members 110 in the retaining condition. The illustrated non-fusible members 110 are ball bearings formed of, for example, stainless steel. In other constructions (not shown), the non-fusible members 110 may have a different construction (e.g., a pin, a tube, etc.), be formed of a different material, etc.

The illustrated fusible members 114 are formed as pins of a material (e.g., tin bismuth, a eutectic alloy, etc.) configured to deform (e.g., plastically deform) or melt at or above a threshold temperature. When each fusible member 114 deforms, the associated non-fusible member 110 is able to move and disengage from at least the retaining surface 62. In other constructions (see FIGS. 4-7), the fusible members 114 may have a different construction (e.g., a washer, a tube, etc.), be formed of a different material (e.g., a polymer (such as polyethylene)), etc. To assemble the cap assembly 10, the cover 18 is installed on the housing 14 with the rim 74 resting on the end surface of the housing 14. In this position, the bores 90 are arranged relative to the groove 58 to facilitate positioning of the non-fusible members 110 between the retaining surfaces 62, 94. With the full-circumference groove 54, the cover 18 may be positioned in any orientation relative to the housing 14.

In constructions (not shown) in which the recess 54 does not extend about the full circumference (e.g., separate recesses, an interrupted groove, etc.), the cover 18 may be installed in a limited number of orientations relative to the housing 14. The cover 18 and the housing 14 may include an indication (not shown) of proper orientations for installation.

A non-fusible member 110 is positioned in each bore 90 to project from the radially-extending portion 102 toward the groove 58. Each non-fusible member 110 may be inserted through the axially-extending portion 98 to move into the radially-extending portion 98. Alternatively, if sized appropriately, each non-fusible member 110 may be inserted into the open end of the radially-extending portion 102. However, in some constructions, the open end of the bore portion 102 may be constructed and sized to allow the non-fusible member 110 to project outwardly into engagement with the housing 18 while retaining the non-fusible member 110 in the bore 90.

With the non-fusible members 110 installed, a fusible member 114 is inserted into each axially-extending portion 98. The radially-extending portions of the bores 90 and the non-fusible members 110 are sized such that, when the fusible members 114 are fully inserted, the non-fusible members 110 are in the retaining condition (see FIG. 2). When fully inserted, the fusible members 114 extend below the radially-extending portion 102 to prevent the non-fusible members 110 from pushing the fusible members 114 out of the bore 90.

In some examples, the fusible member 114 is deformed to fill behind the non-fusible member 110 (e.g., in the axially-extending portion and in the radially-extending portion of the bore 90). Deforming the fusible member 114 may force engagement of the retainer assembly 22 (e.g., cause the non-fusible member 110 to fully engage the groove 58 in the retaining condition). This may improve functioning of the retainer assembly 22, eliminating manufacturing tolerances in the components, etc. In other constructions (not shown), the fusible member 114 may be inserted into the bore 90 with a press fit.

Additional structure (e.g., a metal ring (not shown)) may be installed after each fusible member 114 to provide increased retention of the fusible member 114. The structure may more precisely control retraction of the associated non-fusible member 110 by acting as an orifice limiting the flow of the material of the fusible element 114 in its liquid state.

In operation, the cap assembly 10 is installed on the container C. Under normal conditions (e.g., with the conditions in the container C less than a threshold at which the fusible members 114 melt or deform), the fusible members 114 hold the non-fusible members 110 in the retaining condition, and the cover 18 is connected to the housing 14. If conditions in the container C are such that venting becomes desirable and the threshold is reached, the fusible members 114 deform. With the fusible members 114 deformed, the non-fusible members 110 are able to move away from the groove 58 toward the junction of the bore portions 98, 102.

With the non-fusible members 110 out of engagement between the retaining surfaces 62, 94 (the release condition), pressure in the container C forces the cover 18 out of the housing 14, and the container C is opened and vented to atmosphere. The retaining surfaces 62, 94 may be oriented to force the non-fusible members 110 to move into the bores 90 and away from the groove 58 as the cover 18 disengages from the housing 14.

Figure 4:
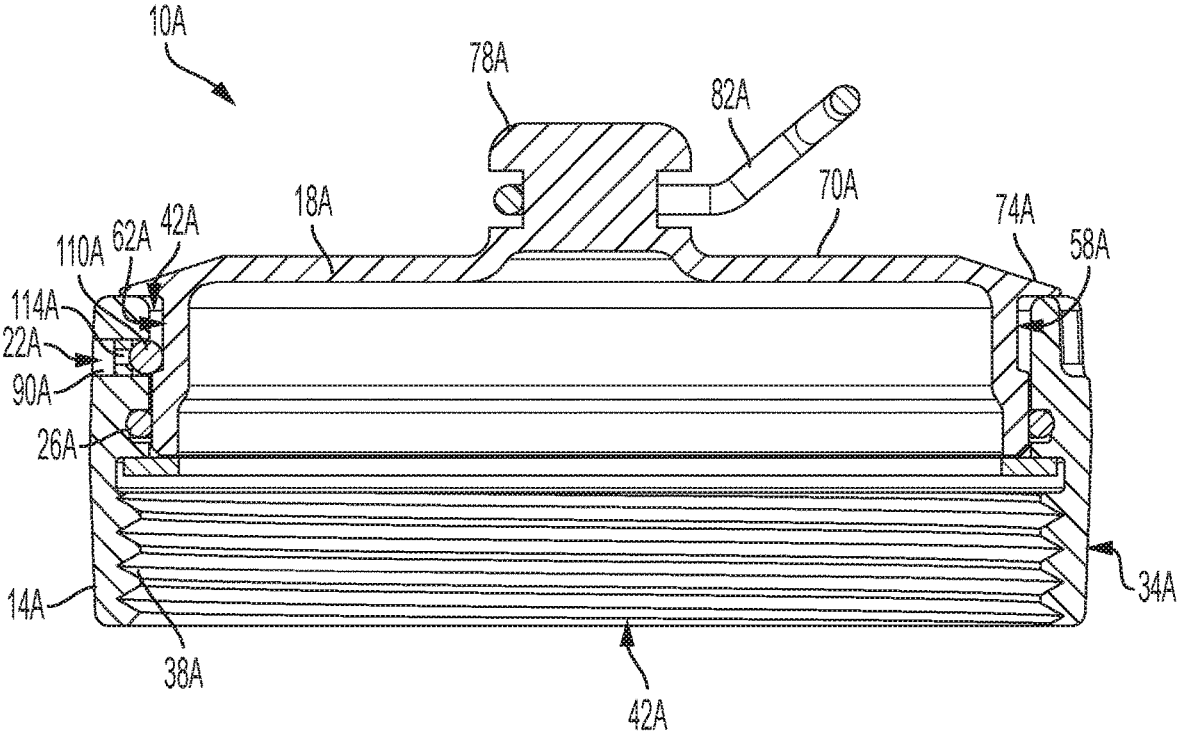
FIG. 4 is a cross-sectional side view of an alternative construction of a cap assembly.
Figure 5:
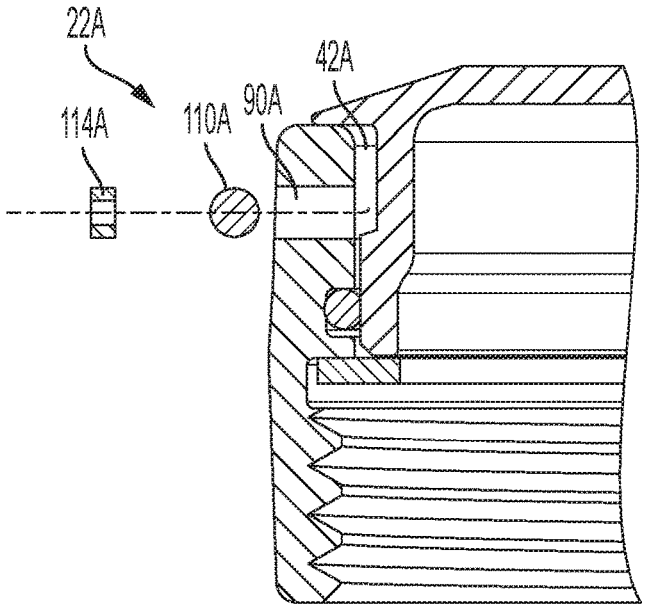
FIG. 5 is an enlarged cross-sectional view of a portion of the cap assembly of FIG. 4.

FIGS. 4-5 illustrate an alternative construction of a cap assembly 10A. The cap assembly 10A is similar to the cap assembly 10 described above and shown in FIGS. 1-3, and common elements have the same reference number "A".

In the illustrated construction, the arrangement of the retainer member(s) and the retaining surface is reversed. More specifically, a wide groove 58A with the retaining surface 62A is defined in the body 70A of the cover 18A, and the non-fusible member(s) 110A and the fusible member(s) 114A are supported in the associated bore(s) 90A on the housing 14A. The illustrated bores 90A extend radially from the outer surface of the housing 14A into the opening 42A.

A non-fusible member 110A is positioned in each bore 90A, and then a fusible member 114A is fully inserted to releasably hold the non-fusible member 110A in the retaining condition (see FIG. 4). Each illustrated fusible member 114A is in the form of a washer of fusible material.

Figure 6:
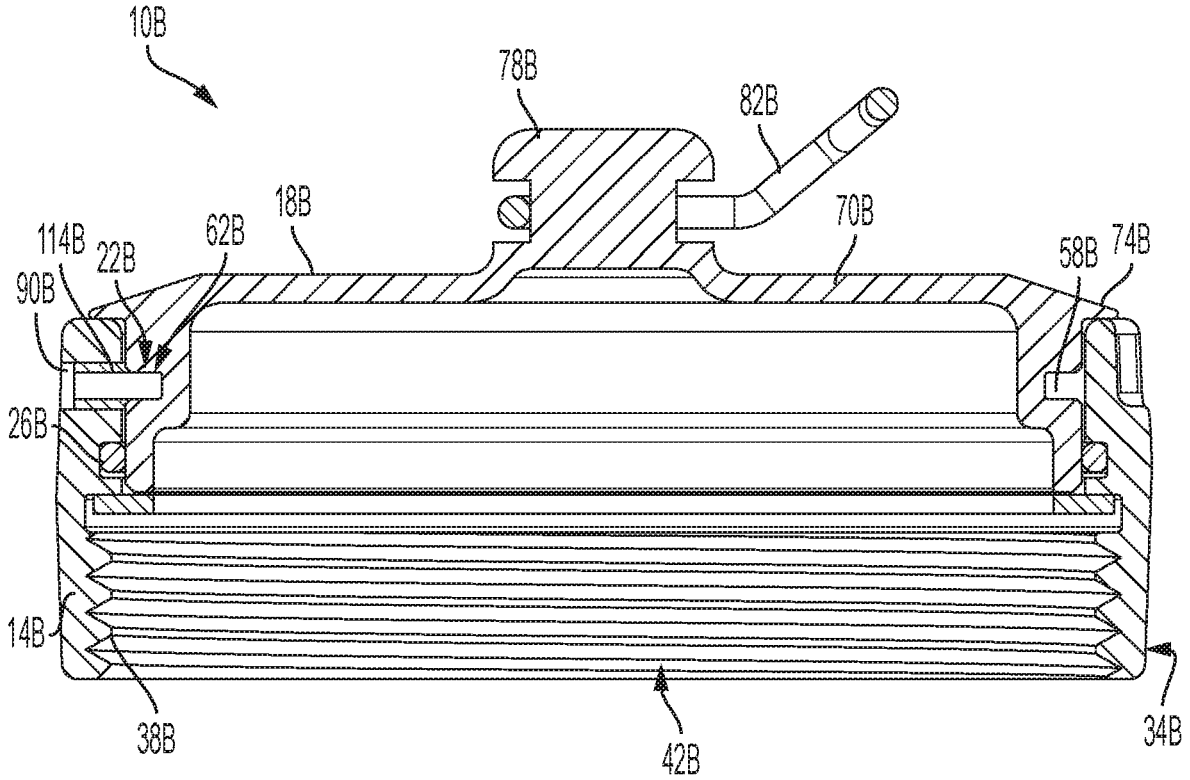
FIG. 6 is a cross-sectional side view of another alternative construction of a cap assembly.

FIG. 6 illustrates another alternative construction of a cap assembly 10B. The cap assembly 10B is similar to the cap assembly 10, 10A described above and shown in FIGS. 1-5, and common elements have the same reference number "B".

In the illustrated construction, like the cap assembly 10B, a groove 58B, with the retaining surface 62B, is defined in the body 70B of the cover 18B, and the housing 14B defines the radially-extending bore(s) 90B.

Each illustrated fusible member 114B is in the form of a hollow tube of fusible material (e.g., polyethylene). In the illustrated construction, the fusible member(s) 114B also act as the retainer member(s). A fusible member 114B is fully inserted into each bore 90B and into the groove 58B to the retaining condition (see FIG. 5). The fusible member 114B and the groove 58B are sized so that the fusible member 114B is held (e.g., by friction) in the retaining condition. At or above the threshold, the fusible member 114B deforms and allows the cover 18B to disengage from the housing 14B.

Figure 7:
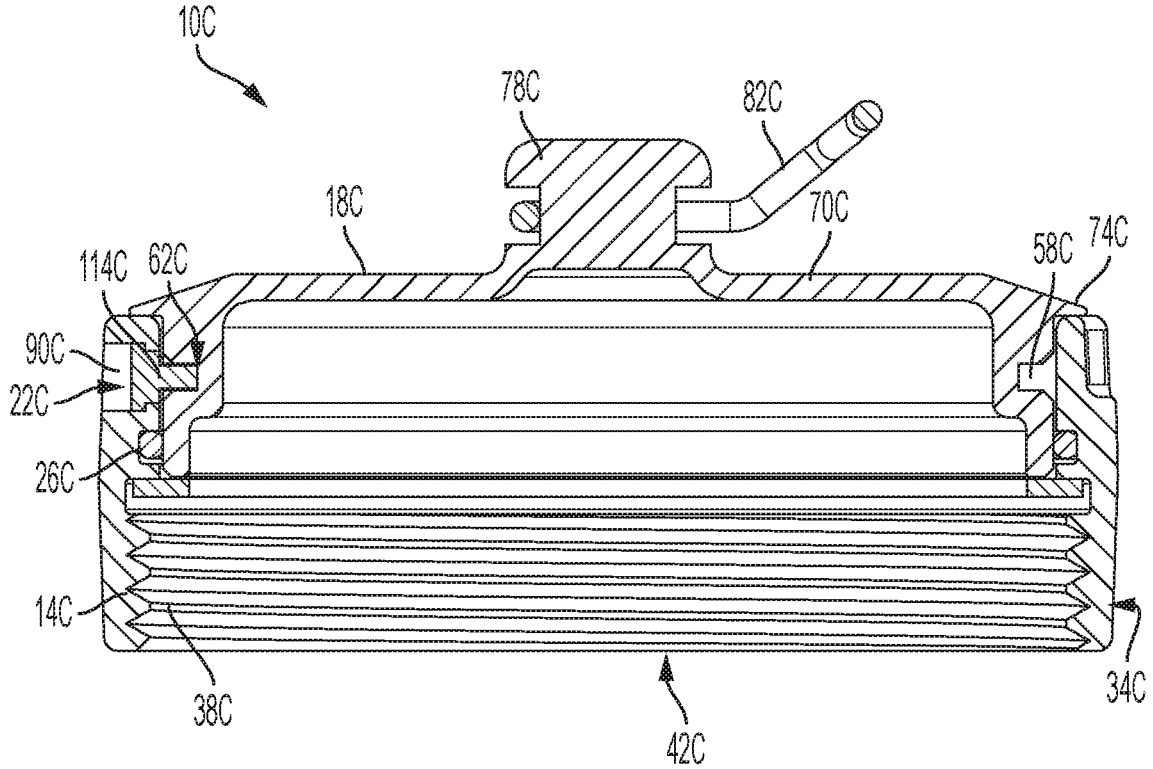
FIG. 7 is a cross-sectional side view of yet another alternative construction of a cap assembly.
Figure 7A:
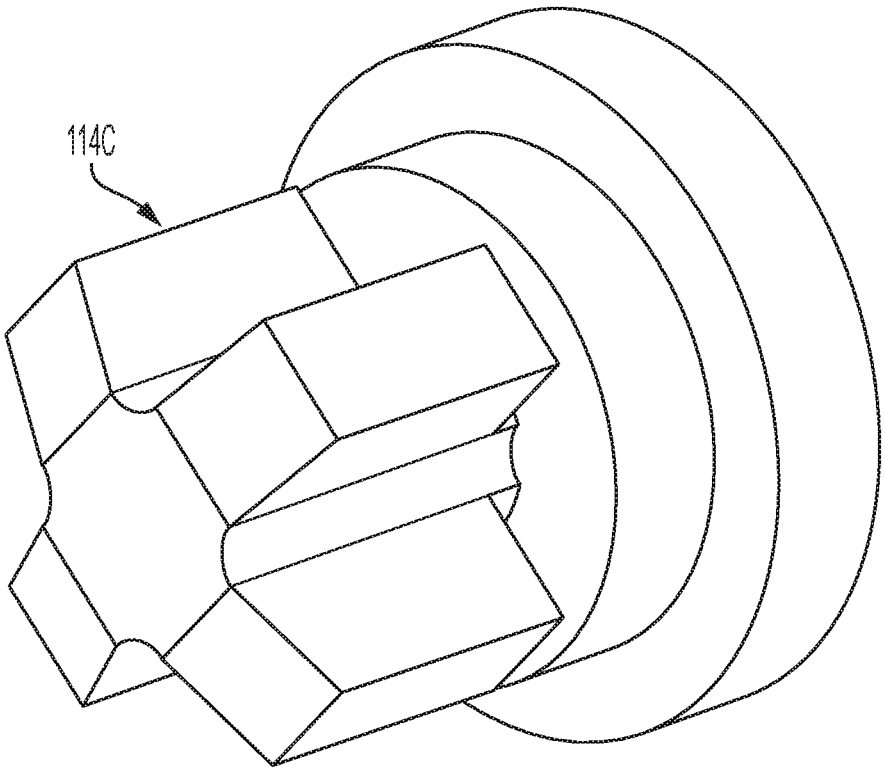
FIG. 7A is a perspective view of a retainer member as shown in FIG. 7.

FIGS. 7-7A illustrate a further alternative construction of a cap assembly 10C. The cap assembly 10C is similar to the cap assembly 10, 10A, 10B described above and shown in FIGS. 1-6, and common elements have the same reference number "C".

In the illustrated construction, like the cap assembly 10B, a narrow groove 58C, with the retaining surface 62C, is defined in the body 70C of the cover 18C, and the housing 14C defines the radially-extending bore(s) 90C. The illustrated bore 90C is stepped.

In the illustrated construction, the fusible member(s) 114C also act as the retainer member(s). A fusible member 114C is fully inserted into each bore 90C and into the groove 58C to the retaining condition (see FIG. 7). The fusible member 114C and the groove 58C are sized such that the fusible member 114C is held (e.g., by friction) in the retaining condition. At or above the threshold, the fusible member 114C deforms and allows the cover 18C to disengage from the housing 14C.

Each illustrated fusible member 114C is in the form of a pin of fusible material (e.g., polyethylene). The pin has a head limiting movement of the fusible member 114C through the bore 90C into the opening 42C. The body of the pin has a generally X-shaped cross-section to provide support in the round bore 90C in the housing 14C and to deform to square shape of the groove 54C in the cap 18C.

Figure 10:
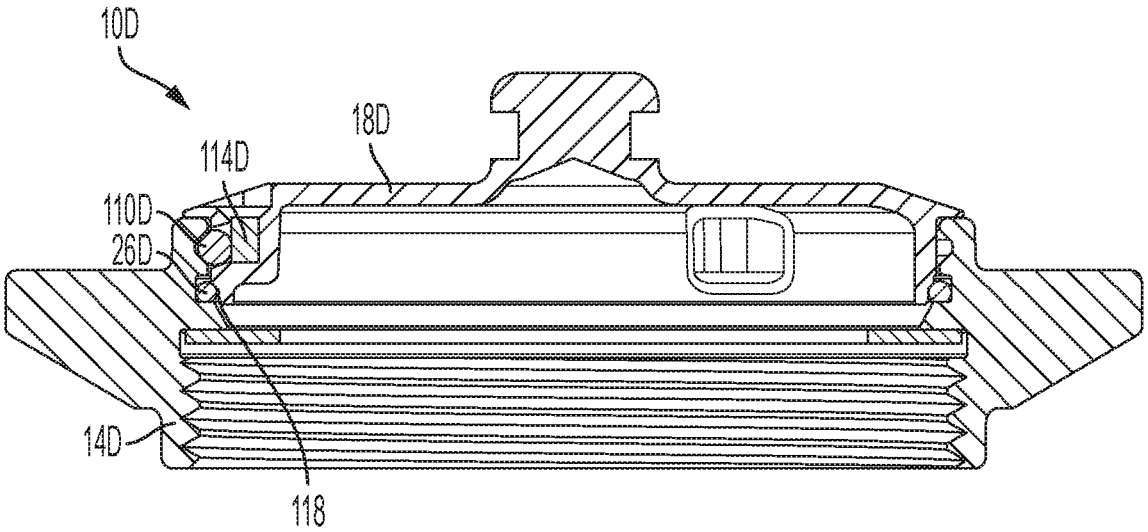
FIG. 10 is a cross-sectional side view of another alternative construction of a cap assembly.

FIG. 10 illustrates an alternative construction of a cap assembly 10D. The cap assembly 10D is similar to the cap assembly 10, 10A, 10B, 10C described above and shown in FIGS. 1-8, and common elements have the same reference number "D".

The cap assembly 10D has a compact design which may, for example, reduce costs of manufacturing, production, provide a lower profile in use, etc. The height of each of the housing 14D and the cover 18D are relatively shorter than the height of the corresponding components of the cap assemblies 10, 10A, 10B, 10C shown in FIGS. 1-8. An angled surface 118 of the cover 18D that interacts with the seal 26D helps push the cover 18D out of the housing 14D if the fusible member 114D melts to vent the container C.

In some examples, the cap assembly 10, 10A, 10B, 10C, 10D, 10E may be include a combination relief vent and closure apparatus, such as that described in U.S. Pat. No. 5,240,027, the entire contents of which are hereby incorporated by reference. In such examples, the non-fusible members 110E and the fusible members 114E may be used in place of lead solder of the combination apparatus described and illustrated in U.S. Pat. No. 5,240,027.

Figure 11:
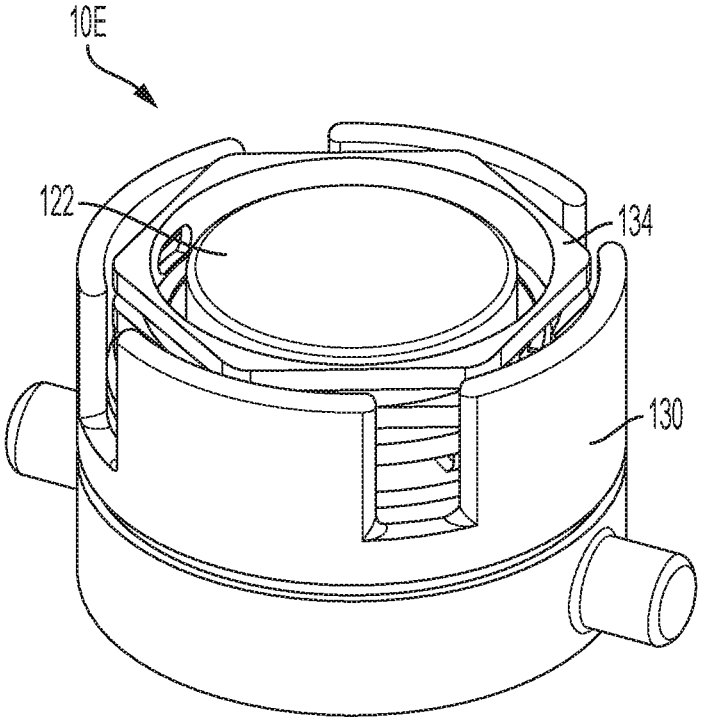
FIG. 11 is a perspective view of yet another alternative cap assembly including a combination relief vent.
Figure 12:
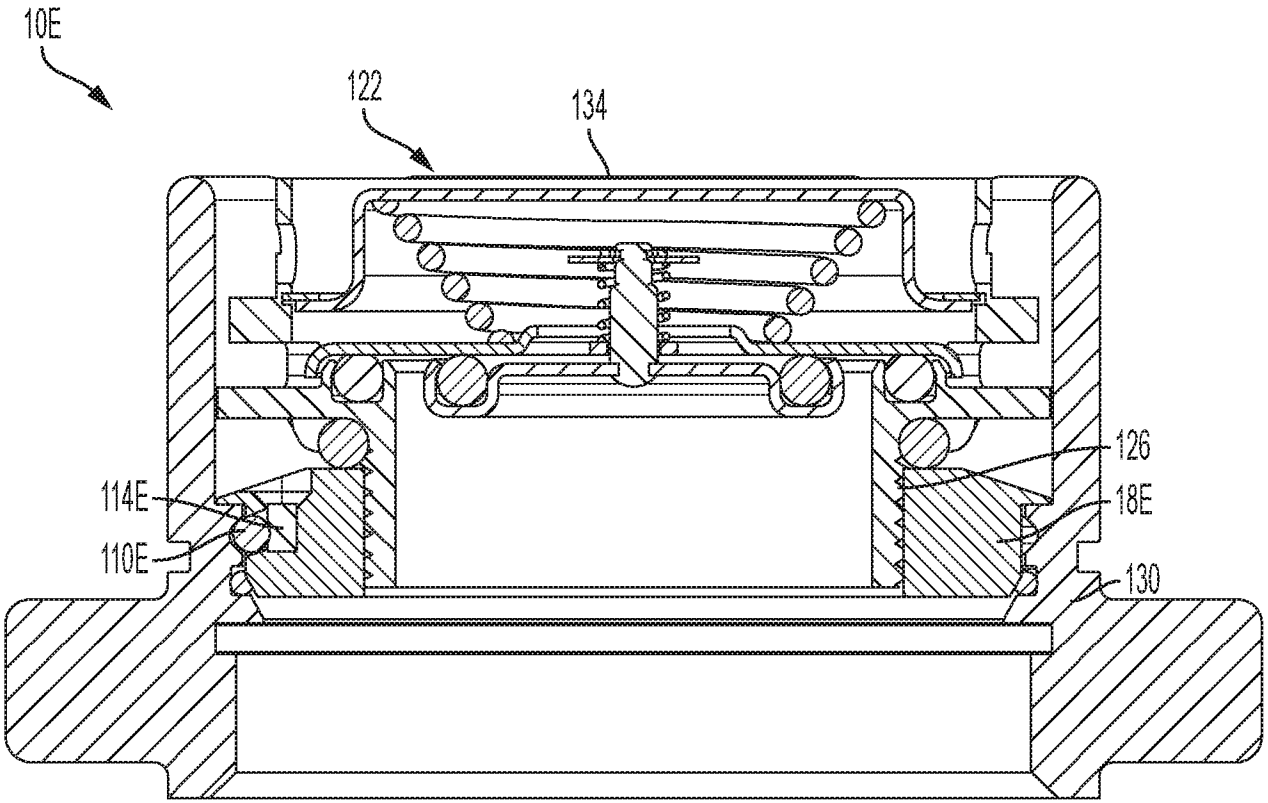
FIG. 12 is a cross-sectional side view of the cap assembly of FIG. 11.

FIGS. 11-12 illustrate another alternative cap assembly 10E including a combination relief vent 122. The cap assembly 10D is similar to the cap assembly 10, 10A, 10B, 10C, 10D described above and shown in FIGS. 1-10, and common elements have the same reference number "E".

The illustrated relief vent 122 is connected (e.g., via a threaded connection 126) to the cover 18E of the cap assembly 10E. In other constructions (not shown), the relief vent 122 may be connected to the cover 18E via other suitable means or may be formed with the cover 18E.

As discussed above, the cover 18E with the relief vent 122 is connected to the housing 130 via a release assembly 22E. The illustrated housing 130 extends up to a top surface 134 of the relief vent 122 in order to prevent unwanted impacts to the relief vent 122.

The retainer assembly 22E is operable, at or above the threshold, to release the cover 18E from the housing 130 to vent the container C to atmosphere. In the event the cover 18E is released from the cap assembly 10E, the relief vent 122 is released along with the cover 18E. A strap may be coupled to the cover assembly 18E and to the container C to prevent loss of the cover 18E if the cover 18E is released from the cap assembly 10E.

In some constructions, the above-described cap assembly 10, 10A, 10B, 10C, 10D may be used with a bi-directional valve, such as that described in U.S. patent application Ser. No. 16/714,268, filed Dec. 13, 2019, entitled "BI-DIRECTIONAL VENT", which is hereby incorporated by reference in its entirety.

In such constructions, the relief vent for selectively sealing an opening of an enclosed chamber may include a body, a first poppet, a second poppet, and a face seal. The body is configured to be coupled to the enclosed chamber. The first poppet is disposed within the body and is biased by a first biasing member. The first poppet includes a first surface. The second poppet is disposed within the body and includes a second surface. The second poppet is biased toward the first poppet such that the second surface is biased toward engaging the first surface. The face seal is positioned between the first surface and the second surface.

Although the invention has been described in detail with reference to certain independent embodiments, variations and modifications exist within the scope and spirit of one or more independent aspects of the invention as described.

What is claimed is:

1. A cap assembly for a container, the container including a container opening and having a condition, the cap assembly comprising:

a housing couplable to the container opening, the housing defining a housing opening communicating with the container opening;

a cover operable to close the housing opening; and a retainer mechanism operable to releasably connect the cover to the housing, the retainer mechanism including a non-fusible member selectively contacting the cover and the housing, and a fusible member operable to hold the non-fusible member in direct contact with the cover and the housing in a retaining condition, the fusible member deforming at or above a threshold of the condition to allow the non-fusible member to move out of direct contact with one of the cover and the housing, in a release condition, to open the container opening to atmosphere.

2. The cap assembly of claim 1, wherein the housing opening defines an axis, wherein one of the housing and the cover has a surface extending non-parallel to the axis, and wherein the non-fusible member engages the surface in the retaining condition and disengages the surface in the release condition.

3. The cap assembly of claim 2, wherein the other of the housing and the cover defines a recess, and wherein the non-fusible member is movable into the recess away from the surface from the retaining condition toward the release condition.

4. The cap assembly of claim 3, wherein the recess includes a bore, and wherein the fusible member is positioned in the bore.

5. The cap assembly of claim 4, wherein the bore includes an axially-extending portion and a radially-extending portion, and wherein the non-fusible member is positioned in the radially-extending portion and the fusible member is positioned in the axially-extending portion.

6. The cap assembly of claim 1, wherein the non-fusible member includes a ball bearing.

7. The cap assembly of claim 1, wherein the fusible member includes a pin or a washer.

8. The cap assembly of claim 1, wherein the fusible member is formed of a material plastically deformable at or above the threshold.

9. The cap assembly of claim 8, wherein the material of the fusible member includes tin bismuth, a polymer material or combinations thereof.

10. The cap assembly of claim 1, wherein the retainer mechanism includes a plurality of non-fusible members, each associated with a fusible member.

11. The cap assembly of claim 10, wherein the housing opening defines an axis, wherein one of the housing and the cover has an annular surface extending about and non-parallel to the axis, and wherein the plurality of non-fusible members engage the surface in the retaining condition and disengage the surface in the release condition.

12. The cap assembly of claim 1, further comprising a relief vent coupled to the cover.

13. The cap assembly of claim 1, wherein the housing has a housing retaining surface and the cover has a cover retaining surface, and wherein, in the retaining condition, the non-fusible member directly contacts the cover retaining surface and the housing retaining surface.

14. A cap assembly for a container, the container including a container opening and having a condition, the cap assembly comprising:

a housing couplable to the container opening, the housing defining a housing opening communicating with the container opening;

a cover operable to close the housing opening; and a retainer mechanism operable to releasably connect the cover to the housing, the retainer mechanism including a non-fusible member selectively contacting the cover and the housing, and a fusible member operable to hold the non-fusible member in contact with the cover and the housing in a retaining condition, the fusible member deforming at or above a threshold of the condition to allow the non-fusible member to move out of contact with one of the cover and the housing, in a release condition, to open the container opening to atmosphere;

wherein the housing opening defines an axis, wherein one of the housing and the cover has a surface extending non-parallel to the axis, wherein the non-fusible member engages the surface in the retaining condition and disengages the surface in the release condition; and wherein the one of the housing and the cover defines a groove providing the surface.

15. A cap assembly for a container, the container including a container opening and having a condition, the cap assembly comprising:

a housing couplable to the container opening, the housing defining a housing opening communicating with the container opening, the housing opening defining an axis;

a cover operable to close the housing opening, one of the housing and the cover having a surface extending non-parallel to the axis; and a retainer mechanism operable to releasably connect the cover to the housing, the retainer mechanism including a first non-fusible member and a second non-fusible member selectively directly contacting the cover and the housing, and a first fusible member and a second fusible member operable to hold the first non-fusible member and the second non-fusible member, respectively, in direct contact with the cover and the housing in a retaining condition, the first fusible member and the second fusible member deforming at or above a threshold of the condition to allow the first non-fusible member and the second non-fusible member, respectively, to move out of direct contact with one of the cover and the housing, in a release condition, to open the container opening to atmosphere, wherein the first non-fusible member and the second non-fusible member engage the surface in the retaining condition and disengage the surface in the release condition.

16. The cap assembly of claim 15, wherein the one of the housing and the cover defines an annular groove providing the surface, and wherein the other of the housing and the cover defines a first bore and a second bore, and wherein the first non-fusible member is movable into the first bore and the second non-fusible member is movable into the second bore away from the surface from the retaining condition toward the release condition.

17. The cap assembly of claim 16, wherein the first fusible member is positioned in the first bore and the second fusible member is positioned in the second bore, and wherein each of the first bore and the second bore includes an axially-extending portion and a radially-extending portion, and wherein the first non-fusible member is positioned in the radially-extending portion first bore, the first fusible member is positioned in the axially-extending portion of the first bore, the second non-fusible member is positioned in the radially-extending portion of the second bore, the second fusible member is positioned in the axially-extending portion of the second bore.

18. The cap assembly of claim 15, wherein the first non-fusible member includes a ball bearing.

19. The cap assembly of claim 15, wherein the first fusible member includes a pin or a washer, wherein the first fusible member is formed of a material plastically deformable above the threshold, and wherein the material of the first fusible member includes tin bismuth, a polymer material or combinations thereof.

20. The cap assembly of claim 15, wherein the retainer assembly includes three non-fusible members and three fusible members.

21. A cap assembly for a container, the container including a container opening and having a condition, the cap assembly comprising:

a housing couplable to the container opening, the housing defining a housing opening communicating with the container opening, the housing opening defining an axis;

a cover operable to close the housing opening, one of the housing and the cover having a surface extending non-parallel to the axis, the other of the housing and the cover defining a recess; and a retainer mechanism operable to releasably connect the cover to the housing, the retainer mechanism including a non-fusible member selectively contacting the cover and the housing, and a fusible member operable to hold the non-fusible member in direct contact with the cover and the housing in a retaining condition, the fusible member deforming at or above a threshold of the condition to allow the non-fusible member to move out of direct contact with one of the cover and the housing, in a release condition, to open the container opening to atmosphere, the non-fusible member engaging the surface in the retaining condition and disengaging the surface in the release condition, the non-fusible member being movable into the recess away from the surface from the retaining condition toward the release condition.

* * * * *